US008714884B2

(12) United States Patent
Eigemann

(10) Patent No.: US 8,714,884 B2
(45) Date of Patent: May 6, 2014

(54) ROCK ANCHOR

(75) Inventor: Ernst Eigemann, Essen (DE)

(73) Assignee: Minova Carbotech GmbH, Essen (DE)

( * ) Notice: Subject to any disclaimer, the term of this patent is extended or adjusted under 35 U.S.C. 154(b) by 163 days.

(21) Appl. No.: 13/140,003

(22) PCT Filed: Dec. 21, 2009

(86) PCT No.: PCT/IB2009/007850

§ 371 (c)(1),
(2), (4) Date: Oct. 3, 2011

(87) PCT Pub. No.: WO2010/070445

PCT Pub. Date: Jun. 24, 2010

(65) Prior Publication Data

US 2012/0020744 A1 Jan. 26, 2012

(30) Foreign Application Priority Data

Dec. 19, 2008 (DE) ..... 10 2008 063 814

(51) Int. Cl.
*E21D 20/00* (2006.01)
*B21D 37/00* (2006.01)

(52) U.S. Cl.
USPC ..... 405/259.5; 405/259.1; 72/295; 72/296

(58) Field of Classification Search
USPC ..... 405/259.1–259.6, 262; 428/428; 72/295, 296, 297
See application file for complete search history.

(56) References Cited

U.S. PATENT DOCUMENTS

| | | | | |
|---|---|---|---|---|
| 4,504,175 | A * | 3/1985 | Zion | 405/259.5 |
| 5,114,516 | A * | 5/1992 | Pilling et al. | 156/180 |
| 5,344,256 | A * | 9/1994 | Hedrick | 405/259.1 |
| 6,820,657 | B1 * | 11/2004 | Hedrick | 140/105 |
| 7,562,550 | B2 * | 7/2009 | Steains | 72/302 |
| 2002/0119014 | A1 | 8/2002 | Coombs | |
| 2003/0180098 | A1 | 9/2003 | Malkoski | |
| 2007/0264088 | A1 | 11/2007 | Richter | |

* cited by examiner

*Primary Examiner* — Benjamin Fiorello
(74) *Attorney, Agent, or Firm* — Ladas & Parry LLP

(57) ABSTRACT

A compact apparatus for providing a substantially pressure-tight connection between a source of a plastics component and an opening of an inner channel of a rock bolt. The apparatus includes a central block moveable to be aligned with the rock bolt, a supply pipe slidably arranged in the central block, a first force transmitter, a gripper for attaching the central block to the rock bolt, a gripper drive slidably mounted on the central block and arranged to operate the gripper, and a second force transmitter, such that the first force transmitter is arranged to press the supply pipe onto the opening of the inner channel of the rock bolt. The gripper is mounted on the central block, and the second force transmitter is arranged to operate the gripper drive to force the gripper to clamp the central block onto the rock bolt.

16 Claims, 2 Drawing Sheets

ROCK ANCHOR

This application is a 371 of PCT/IB2009/007850 filed on Dec. 21, 2009, which is incorporated herein by reference.

The invention relates to an apparatus for connecting supply pipes for plastics components to the inner channel of a rock bolt (anchor rod) in a pressure-tight manner.

BACKGROUND OF THE INVENTION

A rock bolt may be used to stabilise a rock mass formation by the steps of drilling a drill hole in the rock mass, inserting the rock bolt into the drill hole and then securing the rock bolt in place with a cement grout or a resin. It is known to use a self-drilling rock bolt such that the second step is avoided.

An apparatus for connecting supply pipes to the inner channel of a rock bolt is described in Applicant's prior application DE 10 2005 050 929.0-24 A1. The apparatus disclosed in this document delivers plastics components separately to the inner channel of the rock bolt which has a static mixer to mix the components. This document discloses selecting the plastics components so that their cure time is substantially the same as the time for filling the inner channel and the drill hole surrounding the anchor rod. Thus the plastic components harden in such a way that the anchor rod does not longer fall out of the drill hole and no plastics material seep out of the drill hole. This method enables anchor rods to be set in place quickly as it is not necessary to wait for hardening or to seal the drill hole.

SUMMARY OF THE INVENTION

It is an object of the invention to design the apparatus so that it permits a substantially pressure-tight connection to be made, for example at pressures of more than 100 bar, such that automatic operation is possible with improved safety of operation.

According to the invention there is provided an apparatus for providing a substantially pressure-tight connection between a source of a plastics component and an opening of an inner channel of a rock bolt wherein the apparatus comprises a central block moveable to be aligned with the rock bolt, a supply pipe slidably arranged in the central block, a first force transmitter, a gripper for attaching the central block to the rock bolt, a gripper drive slidably mounted on the central block and arranged to operate the gripper, and a second force transmitter wherein the first force transmitter is arranged to press the supply pipe onto the opening of the inner channel of the rock bolt; wherein the gripper is mounted on the central block; and wherein the second force transmitter is arranged to operate the gripper drive to force the gripper to clamp the central block onto the rock bolt.

The advantages of the invention include that very high contact pressing forces can be applied, as the rock bolt cannot move. By using two force transmitters, to which force can be applied separately, flexible control logic is possible, wherein by corresponding locking of the hydraulic connections, the unintentional supply of plastics components can be avoided even when manually operated. A compact construction is made possible because the supply pipe is guided so as to slide in the central block. An advantage of having a compact construction is that the apparatus is manoeuvrable such that it is easy to position the apparatus exactly flush with the rock bolt.

In some embodiments, the first force transmitter is provided by the supply pipe and the central block being arranged as a first hydraulic chamber/piston pairing. The first hydraulic chamber/piston pairing may be arranged concentrically in relation to one another such that each of the parts supports the other. In some embodiments, the supply pipe has a stepped shape forming a piston and the central block has a correspondingly stepped shaped recess such that the piston of the supply pipe is guided in the stepped chamber of the central block to form the first hydraulic chamber/piston pairing. In some embodiments, the hydraulic chamber of the first hydraulic chamber/piston pairing is an annular chamber, for example formed by the stepped recess of the central block, the supply pipe and the supply pipe piston.

In some embodiments, the second force transmitter is provided by the gripper drive and the central block being arranged as a hydraulic chamber/piston pairing. The hydraulic chamber/piston pairing may be arranged concentrically in relation to one another such that each of the parts supports the other. In some embodiments, the central block may have a stepped shape and the gripper drive may have a correspondingly stepped shaped recess such that the central block forms a piston which is guided in the stepped chamber of the gripper drive to form the second hydraulic chamber/piston pairing. In some embodiments, the hydraulic chamber of the second hydraulic chamber/piston pairing is formed by the stepped shaped recess of the gripper drive, the central block and the supply pipe.

The advantages of providing the first and second force transmitters as hydraulic chamber/piston units which are formed concentrically in relation to one another on the central block include that the apparatus can thereby be attached to a carriage or similar transport device and can easily be positioned flush in front of the anchor rod inserted into the drill hole. Constructing the first and second force transmitters in this way provides a simple design for the force transmitters as simple available components are used as hydraulic components. These features therefore contribute to the compact construction of the apparatus.

In some embodiments, the central block has a guide pipe extending from its side facing away from the rock bolt wherein the gripper drive is slideably mounted on the guide pipe to form the second hydraulic chamber/piston pairing. The advantages of this embodiment include that a reduction in the size of the apparatus is achieved without a decrease in functional capability.

In some embodiments, the gripper has gripper arms which are pivotally mounted on the central block and the gripper drive has toggle levers pivotally connected to the gripper arms wherein the gripper drive is moveable between a first position where the gripper arms are open and a second position where the toggle levers engage to close the gripper arms. In some embodiments, the gripper arms may comprise gripper jaws for engaging the rock bolt. The advantages of this embodiment include that it allows for a compact construction and that a high grip force and secure gripping of the rock anchor is made possible even with little hydraulic pressure.

In some embodiments, the supply pipe may comprise feed pipes for at least two plastics components. The supply pipe may have a plurality of lumen for supplying the at least two plastics components. The advantages of putting the feed pipes together in one supply pipe include that it is easier to ensure that both plastics components are delivered to the inner channel at the same time and in the pre-determined ratio. In this way, the situation is avoided where one particular component which does not hardened is delivered in excess to the inner channel and drill hole and thereafter causes environmental pollution by leaking out.

In some embodiments, the supply pipe may have two concentric pipes arranged pipe-in-pipe inside it to form an annular pipe and a central pipe to separately feed the plastics components. The advantages of this embodiment include that both plastics components are delivered separately and safely, whilst saving space and without being damaged, to the connection of the apparatus to the inner channel of the rock bolt.

In some embodiments, the gripper drive may be biased into the first position where the gripper arms are open. The gripper drive may be biased into the first position by a spring. The spring may be positioned opposite the central block. The advantages of this arrangement include that it allows automatic operation. This is because the apparatus can be moved to the opening of the anchor rod and aligned flush with it without the risk of the gripper and the gripper arms being damaged.

In some embodiments, the apparatus may comprise a coupling piece to connect the supply pipe to the feed pipes wherein the coupling piece is releasably attached to the apparatus, for example it may be releasably attached to the supply pipe. The coupling piece may be releasably attached to the end of the supply pipe face away from the rock bolt, for example by a screw fitting. The advantages of this embodiment include that the coupling piece may also be used to assemble the apparatus. By removing, for example by unscrewing, the coupling piece, the apparatus, with a few hand movements and without using any tools, can be disassembled when faults occur, which is particularly advantageous in underground operation.

In some embodiments, the supply pipe is formed from two concentric pipes arranged pipe-in-pipe inside it to form an annular lumen and a central lumen to separately feed the plastics components and the coupling piece has a radial connection for a feed pipe for connecting the feed pipe to the annular lumen and a coaxial connection for a feed pipe for connecting the feed pipe to the central lumen. The advantages of this embodiment include that it allows easy connection of the feed pipes to the supply pipe to deliver the plastics components safely and separately.

According to the invention there is also provided an apparatus for connecting supply pipes for plastics components to the inner channel of a rock bolt (anchor rod) in a pressure-tight manner, the opening to which rock bolt projects from a drill hole, wherein the plastics components, after mixing, harden to cement the rock bolt in the drill hole, characterised in that:

the feed pipes (28,29) are put together in one supply pipe (8), the supply pipe is guided so as to slide in a central block (5), the central block can be positioned (support frame 1) so that the supply pipe is flush with the rock bolt (3), the supply pipe (8) can be pressed with the feed pipes on to the opening of the rock bolt, projecting from the rock, by means of a first force transmitter (pressing device 20, 21), the central block can be clamped onto the head of the rock bolt, projecting from the rock, by means of a second force transmitter (clamping device), the pressing device and the gripper drive 15 are each designed as a hydraulic cylinder/piston pairing, which, concentric in relation to one another, support one another in and on the central block.

In some embodiments, the pressing device is formed by the supply pipe being guided as a stepped piston (20) in the central block forming the cylinder and the stepped cylinder chamber (21).

In some embodiments, the gripper drive comprises gripper tongs (11) and the second force transmitter, wherein the gripper tongs have double arms (two-armed levers 11), each two-armed lever consists of a gripper arm having gripper jaws (12) and a lever power arm, each two-armed lever can be pivoted about a tongs shaft (10) attached to the central block, the second force transmitter is formed so that a toggle lever drive block (13) is mounted, so as to slide on the central block preferably on a guide pipe tube? 7 attached to said toggle lever drive block (13) and concentrically to the guide pipe, forming by a diameter stage an annular cylinder chamber, (16) and the toggle lever drive block is connected to the lever power arms of the gripper tongs via toggle lever connections (14).

In some embodiments, the toggle lever drive block is supported by a spring (23) opposite the central block for the purpose of slackening the gripper tongs (13).

In some embodiments, the supply pipe has two concentric pipes arranged pipe-in-pipe inside it, which form an annular pipe and a central pipe to separately feed the plastics components.

In some embodiments, the supply pipe (8) is connected to the feed pipes via a coupling piece which is attached so as to be releasable to the end facing away from the rock bolt.

In some embodiments, in the coupling piece the annular pipe is connected to the one plastics feed pipe via a plastics channel, joining radially, and the central pipe is connected to the other plastics feed pipe via a coaxial plastics channel.

In some embodiments, the central block on the side facing away from the rock bolt has a guide pipe (7) of lesser diameter, on which the toggle lever drive block is mounted so as to slide forming the diameter stage.

It should be understood herein that the reference to a substantially pressure tight connection is intended to refer to a connection where any pressure loss between the optionally pressurised source of a plastics component and the inner channel of the rock bolt is minimised to be insufficient to affect efficiency and/or safety of operation of the apparatus.

BRIEF DESCRIPTION OF SEVERAL VIEWS OF THE DRAWINGS

In the following, the invention is described with the help of an exemplary embodiment. In particular, the invention is illustrated with reference to the following figures of the accompanying drawings which are not intended to limit the scope of the invention claimed:

DETAILED DESCRIPTION OF THE INVENTION

Figure 1:
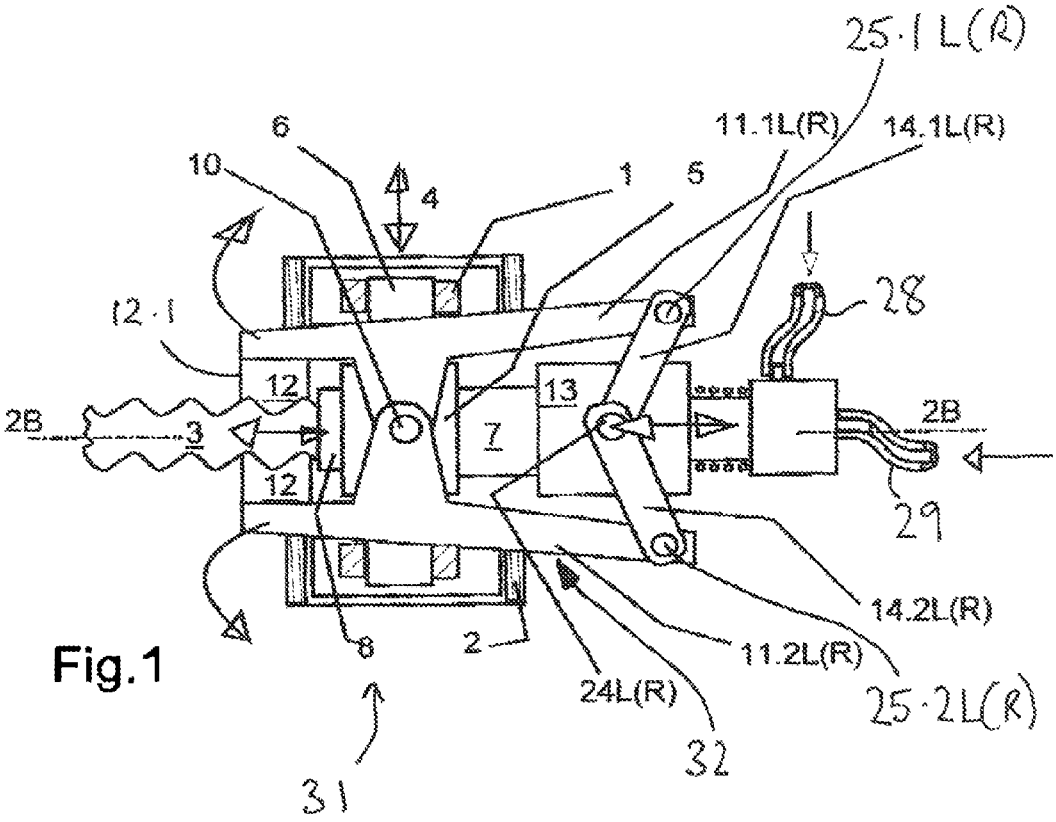
FIG. 1 shows a plan view of an embodiment of the invention.
Figure 2A:
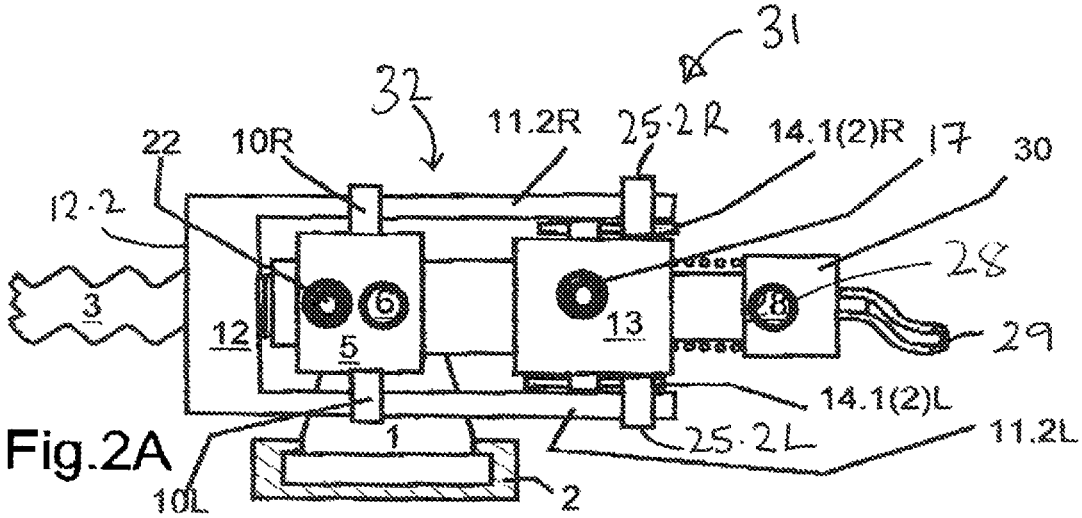
FIGS. 2A and 2B respectively show a side view and a cross-sectional view of the embodiment of the invention.
Figure 2B:
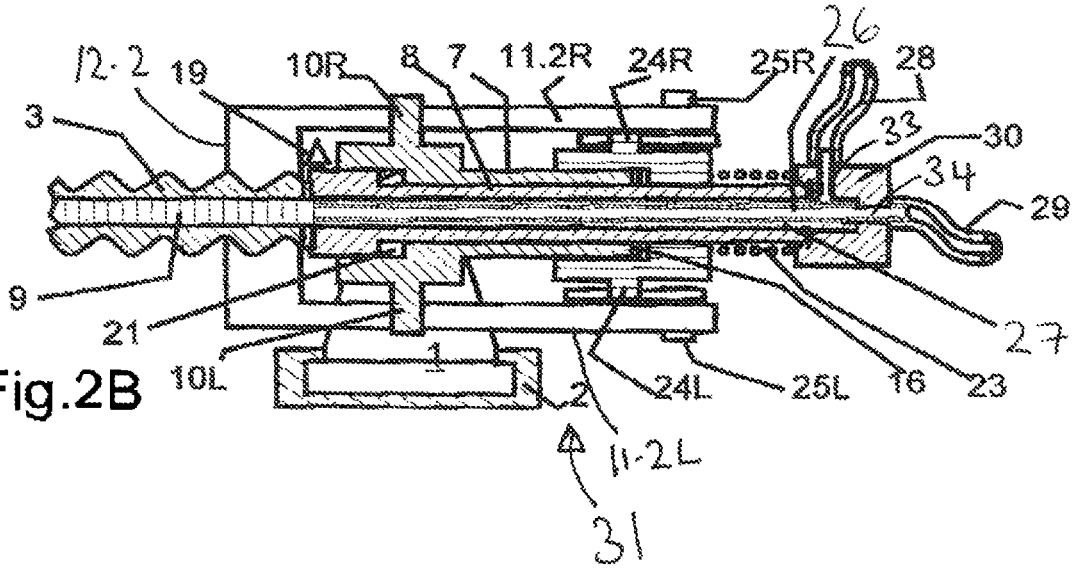

FIGS. 1, 2A and 2B show a compact apparatus 31 for connecting a source of a plastics component in the form of feed pipes 28,29 for plastics components to an inner channel 9 of a rock bolt 3 (also referred to in the following description as an anchor rod 3) in a substantially pressure-tight manner. In operation, rock bolt 3 is generally positioned in a drill hole (not shown) such that a proximal end of the rock bolt 3 protrudes from the drill bole. The rock bolt 3 has an opening and inner channel 9 of rock bolt 3 comprises a static mixer (not shown). The apparatus 31 has a central block 5, a supply pipe 8 for supply of a plastics component, a first force transmitter 20,21,22 for pressing the supply pipe 8 onto the opening of the rock bolt 3, a gripper indicated generally at 32 for attaching central block 5 to the rock bolt 3, a gripper drive 13 for operating the gripper 32, a second force transmitter 16,17 for forcing the gripper drive to operate the gripper 32 to clamp the central block 5 onto the exterior of the proximal end of rock bolt 3, a support frame 1 which is adapted to be slideably mounted in guide track 2, a spring 23 and a coupling piece 30 for connecting feed pipes 28,29 to supply pipe 8.

Central block 5 forms an internal cylindrical channel to slideably accommodate supply pipe 8. Central block 5 has a rock bolt 3 facing distal end on which is formed a stepped shaped block chamber 21. On the proximal end of central block 5 which opposes the rock bolt 3, central block 5 forms a guide pipe 7. Central block 5 is mounted on support frame 1 which is slideably mounted in guide track 2 such that the apparatus can be moved laterally relative to rock bolt 3 along movement axis 4. Central block 5 can be pivoted in the support frame 1 about pivot shaft 6 which is arranged parallel to guide track 2.

Supply pipe 8 has at its distal end a stepped piston 20 which is shaped to correspond with block chamber 21 of the central block 5 such that stepped piston 20 and block chamber 21 form a first hydraulic chamber/piston pairing or first force transmitter. The hydraulic block chamber 21 has an annular shape as it is formed by central block 5, supply pipe 8 and stepped piston 20. Hydraulic fluid is supplied to hydraulic block chamber 21 by hydraulic line 22. The distal end of stepped piston 20 is adapted for being pressed onto the opening of the rock bolt 3. The proximal end of supply pipe 8 is attached to coupling piece 30, for example by a screw fitting (not shown) such that it can easily be removed.

When the apparatus is arranged flush with rock bolt 3 and hydraulic line 22 is operated to fill hydraulic block chamber 21, stepped piston 20 is forced in a distal direction away from the central block such that it abuts and is forced up against the proximal end of rock bolt 3.

Supply pipe 8 has an inner pipe 26 and an outer pipe 27 which forms the exterior of pipe 8. Thus supply pipe 8 has two lumen to separately feed the plastics components which lumen are an annual lumen and a central lumen. Coupling piece 30 is attached to the proximal end of supply pipe 8. Coupling piece 30 has a radial connection 33 for feed pipe 28 for connecting feed pipe 28 to the annular lumen and a coaxial connection 34 for feed pipe 29 for connecting feed pipe 29 to the central lumen.

Gripper 32 has four gripper arms 11.1L,11.2L,11.1R, 11.2R which are mounted on central block 5 on pivots 10R, 10L such that gripper arms 11.1L,11.2L are mounted on pivot 10L and gripper arms 11.1R,11.2R are mounted on pivot 10R. At the distal end of gripper 32, gripper arms 11.1L and 11.1R are connected by jaws 12.1 and gripper arms 11.2L and 11.2R are connected by jaws 12.2 such that jaws 12.1,12.2 are arranged to engage the exterior of the proximal end of the rock bolt 3. At the proximal end of gripper 32, the gripper arms 11.1L,11.2L,11.1R,11.2R of gripper 32 are connected to gripper drive 13 by toggle levers 14.1L,14.2L,14.1R,14.2R at pins 25.1L,25.2L,25.1R,25.2R respectively.

Gripper drive 13 forms an internal cylindrical channel for slideably receiving supply pipe 8. Gripper drive 13 forms on its distal end a stepped shaped drive chamber 16 which is shaped to receive guide pipe 7 such that guide pipe 7 and drive chamber 16 form a second hydraulic chamber 16/piston 7 pairing or second force transmitter. Hydraulic fluid is supplied to the hydraulic drive chamber 16 by hydraulic connection 17. Hydraulic drive chamber 16 has an annular shape as it is formed by gripper drive 13, supply pipe 8 and guide pipe 7. The supply of hydraulic fluid to first and second hydraulic chamber/piston pairings are controlled by control means (not shown).

Gripper drive 13 has toggle lever joints 24L,24R. Toggle levers 14.1L,14.2L are attached to toggle lever joint 24L and toggle levers 14.1R,14.2R are attached to toggle lever joint 24R. The toggle levers 14.1L,14.2L,14.1R,14.2R are arranged such that when the apparatus is arranged flush with rock bolt 3 and second hydraulic chamber 16/piston 7 pairing is operated so that hydraulic drive chamber 16 is filled with hydraulic fluid from hydraulic connection 17, gripper drive 13 moves proximally by sliding on supply pipe 8 away from guide pipe 7, the toggle levers 14.1L,14.2L,14.1R,14.2R are forced outwards to rotate the four gripper arms 11.1L,11.2L, 11.1R,11.2R about pivots 10R,10L such that jaws 12.1,12.2 grip on the exterior of the proximal end of rock bolt 3.

Spring 23 is arranged on the exterior of supply pipe 8 and each end of spring 23 is fixed to gripper drive 13 and to coupling piece 30 such that when gripper drive 13 is moved proximally, the spring 23 is compressed such that when hydraulic fluid is drained from hydraulic drive chamber 16 and from hydraulic block chamber 21, the spring 23 moves the gripper drive 13 distally and supply pipe 8 proximally such that they are returned to their original positions.

Alternatively, the Figures of the accompanying drawings may be described as follows. The apparatus for connecting supply pipes for plastics components to an inner channel of a rock bolt (anchor rod) in a pressure-tight manner, the opening to which rock bolt projects from a drill hole, has two hydraulic force transmitters, clamping device and pressing device 20, 21, functioning as cylinder piston units. The force transmitters have a common component, the central block (5). This central block (5) can be clamped onto the anchor rod 3 by the clamping device and concentrically has a supply pipe which can be connected in a pressure-tight manner to the anchor rod 3 joining.

The central block forms, on the one side of the clamping device, the fixed piston for a cylinder, which is moveably guided on it, toggle lever drive block (13), which serves as the clamping device.

This central block (5) forms, on the other side, the fixed cylinder for the supply pipe (7) designed as a piston and serves as the pressing device 20, 21.

The force of the clamping device is increased by a toggle lever connection.

In detail, the apparatus consists of the following elements:

A support frame 1 is guided so as to be translationally moveable in a guide track 2 with a movement axis 4 aligned perpendicularly to the anchor rod 3. The central block 5 can be pivoted in the support frame about a pivot shaft 6 (alignment shaft) which is parallel to the movement axis 4 of the support frame. The guide pipe 7 is a component part of the central block, which is firmly connected to the central block 5.

A supply pipe 8 for supplying hardening plastics components to the inner channel 9 of the anchor rod 3 is guided in the central block, with the guide pipe 7 attached thereto, concentrically and so as to slide, wherein the axis of the supply pipe essentially intersects the alignment shaft 6 of the central block 5.

By translationally moving and positioning the support frame 1 in the guide track 2 and by pivoting the central block 5 about the pivot shaft 6 (alignment shaft) which is parallel to the movement axis 4 of the support frame, the guide pipe 8 can be positioned flush with the anchor rod 3 and the joining of its inner channel.

Two pivot pins 10.L and 10.R are firmly attached to the central block 5 on the right and left (at the top and the bottom) perpendicularly to the alignment shaft 6 and the guide track 2. These pivot pins are used as the gripper tongs shaft for gripper tongs 11. The gripper tongs have two two-armed lever pairs 11.1 and 11.2 which can be pivoted in opposed directions. Each two-armed lever pair consists of the two left two-armed levers 11.1L and 11.2L and the two right two-armed levers 11.1R and 11.2R.

The two-armed levers, which are parallel to each other, of each two-armed lever pair are connected to one another at the end of the one arm, the gripper arm, by a cross-piece. This cross-piece serves and is designed as the gripper jaw 12 for clasping and gripping the end of the anchor rod 3.

The two-armed levers, which are parallel to each other, of each two-armed lever pair are connected at the free end of the other arm, the power lever arm, to a pair of toggle joint levers.

A toggle lever drive block 13 is used to drive the gripper tongs. This is guided so as to slide, concentrically to the outer circumference of the central block and the guide pipe 7 attached thereto, on the outer circumference of the guide pipe. It is used to drive the two identical toggle lever pairings 14.1L and 14.2L as well as 14.1R and 14.2R, which with their central joints 24L and 24R are coupled to pins on both sides left and right of the toggle lever drive block and are coupled with their free end, in each case, to the other end of the two-armed levers 11.

The hydraulic gripper drive 15 is formed by the toggle lever drive block 13 inside (FIG. 2B) forming a cylinder chamber 16 with the central block and guide pipe 7, wherein the central block is fixed and the toggle lever drive block 13 opposite the central block can be moved in a piston-like manner. The cylinder chamber is sealed opposite the guide pipe 7 at the ends and has a hydraulic connection 17 (FIG. 2A). The toggle lever drive block 13 is supported by a spring 23 opposite the guide pipe for the purpose of slackening the toggle lever, so that the toggle lever pairs buckle about the toggle lever joint 24L and 24R and the gripper jaws 12 are moved for the purpose of slackening. The hydraulic gripper drive 15 functions in such a way that the toggle lever drive block 13 is moved against the force of the spring 23, by the hydraulic pressure built up in the cylinder chamber, for the purpose of extending the toggle lever pairs. By means of this extension, the gripper jaws 12 are moved for the purpose of tension, so that the gripper jaws grip tightly the anchor rod 3, provided with a thread on its circumference, and clamp onto the central block via the pivot pins 10R and 10L, and vice-versa. When this has occurred by means of the gripper drive applying hydraulic pressure, the supply pipe 8 can be pressed in a sealing manner against the opening of the inner channel 9 of the anchor rod 3 with the static mixer arranged therein. A hydraulic sealing drive 19 is used for this purpose. This is formed by the supply pipe on its outer circumference being designed as a stepped piston 20 which in the interior of the central block 5, designed with a staged diameter, forms a cylinder chamber 21. This cylinder chamber is delimited in a sealing manner on one side by the end of the supply pipe 8 with the larger diameter and on the other side by the reducing diameter stage of the interior of the central block 5. The cylinder chamber 21 is connected to a hydraulic line 22.

In FIG. 2B, seals are provided with which, in particular, the hydraulic cylinder chambers are sealed. Providing such seals falls within the competence of a person skilled in the art of hydraulics and therefore will not be described further here.

If the supply pipe 8 is now pressed against the opening of the inner channel 9 of the anchor rod 3, the plastics components can be delivered. For this, two pipes are placed in the inner channel of the supply pipe 8, specifically an inner pipe 26 and an outer pipe 27, concentric in relation to one another. In order to connect these pipes to the plastics feed pipes 28, 29, a fluid coupling 30 is screwed onto the central block, specifically on to the end of the guide pipe projecting from the toggle lever drive block 13. The hoses of the plastics feed pipes 28, 29 are attached to this fluid coupling 30 on the outside. On the inside, they have the separate channels for the inner pipe and the outer pipe. The fluid coupling can also be used to support the spring 23.

It is important for the plastics components to remain separate until they reach the joining to the inner channel 9 of the anchor rod 3 and for them to be mixed only in the anchor rod in the static mixer arranged therein. Thereby, the reaction time for hardening of the plastics components begins at the same point in time as the filling time for filling the drill hole including the inner channel of the anchor rod. The required filling time and the reaction time can, therefore, be exactly matched with one another by adjusting the delivery ratios of the plastics components.

REFERENCE SYMBOLS

1. Support frame 1;
2. Guide track 2;
3. Anchor rod 3; also referred to herein as rock bolt 3;
4. Movement axis 4;
5. Central block 5;
6. Pivot shaft 6 (alignment shaft);
7. Guide pipe 7;
8. Supply pipe 8;
9. Inner channel 9 of the anchor rod 3;
10 Two pivot pins 10 which are each referred to as 10L and 10R; also referred to as gripper tongs shaft 10;
11. Two-armed lever 11; also referred to as gripper arms 11.1L,11.2L,11.1R,11.2R;
12. Gripping jaws 12; also referred to as jaws 12.1,12.2;
13. Toggle lever drive block 13; also referred to herein as gripper drive 13;
14. Two identical toggle lever pairings 14; also referred to herein as toggle levers 14.1L,14.2L,14.1R,14.2R;
15. Hydraulic gripper drive 15;
16. Cylinder chamber 16; also referred to herein as stepped shaped drive chamber 16;
17. Hydraulic connections 17;
18. Annular piston 18;
19. Sealing drive 19;
20. Stepped piston 20, pressing device;
21. Cylinder chamber 21; also referred to herein as stepped shaped block chamber 21;
22. Hydraulic line 22;
23. Spring 23;
24. Toggle lever joint 24; also referred to herein as toggle lever joints 24L,24R;
25. Pin 25; also referred to herein as pins 25.1L,25.2L,25.1R, 25.2R;
26. Inner pipe 26;
27. Outer pipe 27;
28. Plastics feed pipe 28;
29. Plastics feed pipe 29;
30. Fluid coupling 30; also referred to herein as coupling piece 30;
31. Apparatus 31;
32. Gripper 32;
33. Radial connection 33; and
34. Coaxial connection 34.

The invention claimed is:

1. An apparatus for providing a connection between a source of a plastics component and an opening of an inner channel of a rock bolt wherein the apparatus comprises a central block moveable to be aligned with the rock bolt, a supply pipe slidably arranged in the central block, a first force transmitter, a gripper for attaching the central block to the rock bolt, a gripper drive slidably mounted on the central block and arranged to operate the gripper, and a second force transmitter wherein the first force transmitter is arranged to press the supply pipe onto the opening of the inner channel of the rock bolt; wherein the gripper is mounted on the central block; and wherein the second force transmitter is arranged to operate the gripper drive to force the gripper to clamp onto the rock bolt.

2. The apparatus according to claim 1 wherein the first force transmitter is provided by the supply pipe and the central block being arranged as a first hydraulic chamber/piston pairing.

3. The apparatus according to claim 2 wherein the supply pipe has a stepped shape and the central block has a correspondingly stepped shaped recess such that the supply pipe forms a piston which is guided in the stepped cylinder chamber of the central block to form the first hydraulic chamber/piston pairing.

4. The apparatus according to claim 1 wherein the second force transmitter comprises a hydraulic chamber/piston pairing provided by the gripper drive and the central block.

5. The apparatus according to claim 4 wherein the central block has a stepped shape and the gripper drive has a correspondingly stepped shaped recess such that the central block forms a piston which is guided in the stepped cylinder chamber of the gripper drive to form the hydraulic chamber/piston pairing.

6. The apparatus according to claim 5 wherein the central block has a guide pipe extending from its side facing away from the rock bolt to form a piston wherein the gripper drive is slideably mounted on the guide pipe to form the hydraulic chamber/piston pairing.

7. The apparatus according to claim 1 wherein the supply pipe comprises feed pipes for at least two plastics components.

8. The apparatus according to claim 1 wherein the apparatus comprises a coupling piece to connect the supply pipe to the feed pipes wherein the coupling piece is releasably attached to the supply pipe.

9. The apparatus according to claim 8 wherein the supply pipe is formed from two concentric pipes arranged pipe-in-pipe to form an annular pipe and a central pipe to separately feed the plastics components; wherein the coupling piece has a radial connection for a feed pipe for connecting the feed pipe to the annular pipe; and wherein the coupling piece has a coaxial connection for a feed pipe for connecting the feed pipe to the central pipe.

10. The apparatus according to claim 2 wherein the first hydraulic chamber/piston pairing is arranged concentrically in relation to one another such that they support each other.

11. The apparatus according to claim 4 wherein the hydraulic chamber/piston pairing is arranged concentrically in relation to one another such that they support each other.

12. The apparatus according to claim 1 wherein the gripper drive is biased by a spring.

13. The apparatus according to claim 12 wherein the spring is positioned opposite the central block.

14. The apparatus according to claim 7 wherein the supply pipe has a plurality of lumen for supplying the at least two plastics components.

15. The apparatus according to claim 7 wherein the supply pipe is formed from two concentric pipes arranged pipe-in-pipe to form an annular pipe and a central pipe to separately feed the plastics components.

16. The apparatus according to claim 8 wherein the coupling piece is releasably attached to the end of the supply pipe face away from the rock bolt.

* * * * *